US008876592B2

(12) United States Patent
Gomez et al.

(10) Patent No.: US 8,876,592 B2
(45) Date of Patent: Nov. 4, 2014

(54) ENHANCEMENTS OFFERING PERCEIVED VALUE FOR COMMUNITY WAGERING GAME

(75) Inventors: Benjamin T. Gomez, Chicago, IL (US); Daniel P. Louie, Chicago, IL (US); Dion K. Aoki, Chicago, IL (US); Dylan B. Selegue, Reno, NV (US); Noel S. Steere, Chicago, IL (US); Robin L. Littleworth, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 315 days.

(21) Appl. No.: 13/441,345

(22) Filed: Apr. 6, 2012

(65) Prior Publication Data

US 2012/0258790 A1 Oct. 11, 2012

Related U.S. Application Data

(60) Provisional application No. 61/472,866, filed on Apr. 7, 2011.

(51) Int. Cl.
*A63F 9/24* (2006.01)
*G07F 17/32* (2006.01)

(52) U.S. Cl.
CPC ..... *G07F 17/3276* (2013.01)
USPC ..... 463/25; 463/20; 463/42

(58) Field of Classification Search
USPC ..... 463/20, 25, 40, 42
See application file for complete search history.

(56) References Cited

U.S. PATENT DOCUMENTS

| | | | | |
|---|---|---|---|---|
| 6,280,328 | B1 | 8/2001 | Holch et al. | |
| 6,506,117 | B2 * | 1/2003 | DeMar et al. | 463/20 |
| 6,517,433 | B2 | 2/2003 | Loose et al. | |
| 7,662,040 | B2 | 2/2010 | Englman et al. | |
| 7,780,531 | B2 | 8/2010 | Englman et al. | |
| 2003/0045354 | A1 | 3/2003 | Giobbi | |
| 2004/0102243 | A1 * | 5/2004 | Olsen | 463/25 |
| 2006/0019744 | A1 * | 1/2006 | Roemer | 463/26 |
| 2006/0135243 | A1 | 6/2006 | Englman et al. | |
| 2008/0045341 | A1 | 2/2008 | Englman | |
| 2009/0042641 | A1 * | 2/2009 | Anderson et al. | 463/25 |
| 2010/0248812 | A1 * | 9/2010 | Pacey et al. | 463/20 |

OTHER PUBLICATIONS

"The Great and Powerful Oz™" Nevada/ New Jersey/ Mississippi, WMS Gaming Inc., Aug. 9, 2010 (1 page).

* cited by examiner

*Primary Examiner* — Damon Pierce
(74) *Attorney, Agent, or Firm* — Nixon Peabody LLP

(57) ABSTRACT

A gaming system and a method for conducting a wagering game includes a first gaming terminal and a second gaming terminal. The gaming system includes at least two input devices, at least two display devices and at least one processor. The processor operates to display primary wagering games to the first and second gaming terminals in response to receiving one or more wagers at the respective gaming terminals. A first perceived-value enhancement is displayed to the first gaming terminal. The first perceived-value enhancement is active for a first limited period of time and is capable of enhancing a subsequent bonus event. A bonus event is triggered and provided to at least one of the first and second gaming terminals. An enhanced bonus event is provided to the first gaming terminal in response to the bonus event triggered for the first gaming terminal while the first perceived-value enhancement is active.

18 Claims, 9 Drawing Sheets

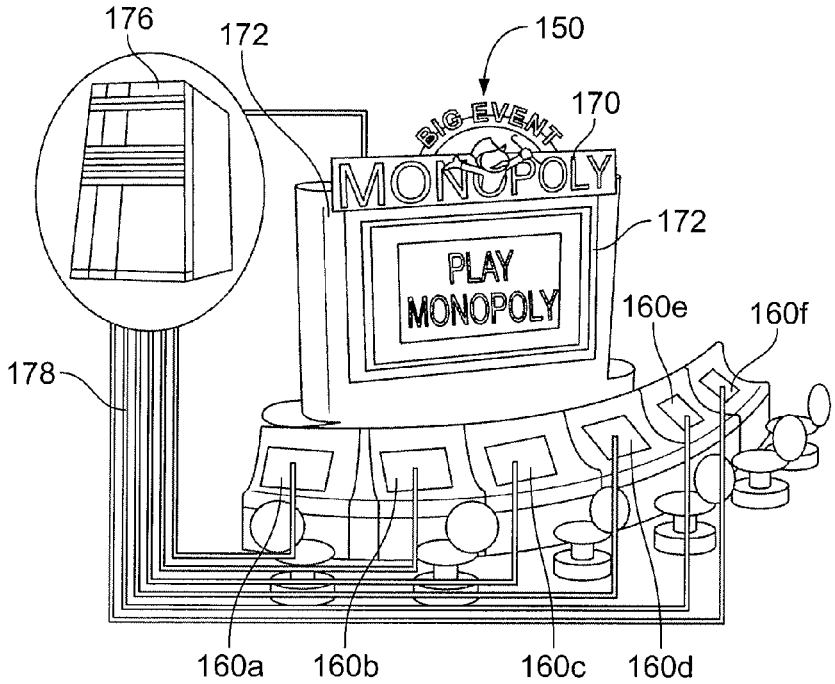
FIG. 4B
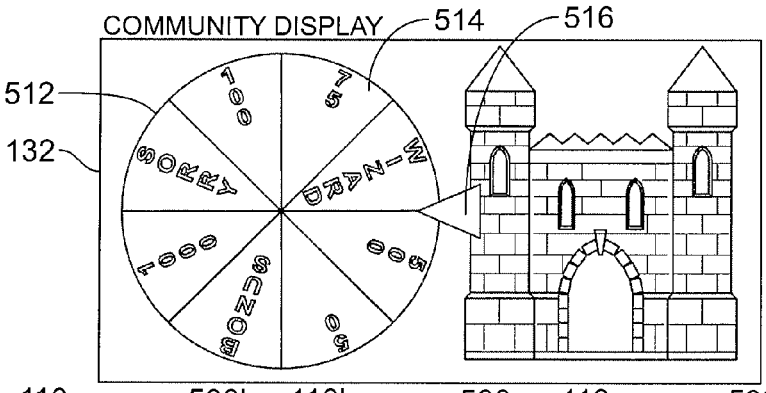
FIG. 5A
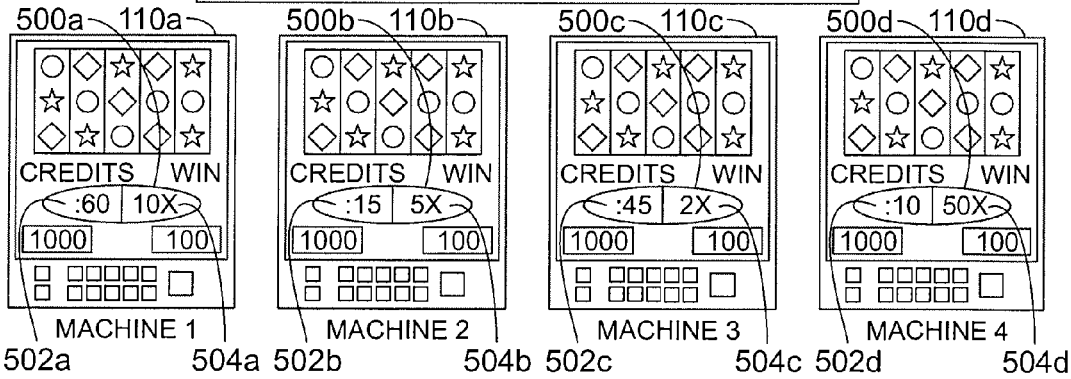

ENHANCEMENTS OFFERING PERCEIVED VALUE FOR COMMUNITY WAGERING GAME

PRIORITY CLAIM AND CROSS REFERENCE TO RELATED APPLICATIONS

This application claims priority to U.S. Provisional Application No. 61/472,866, filed on Apr. 7, 2011 which is incorporated herein its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present invention relates generally to a gaming apparatus, and methods for playing wagering games, and more particularly, to a gaming system offering players increased perceived value in the form of additional enhancements available during an eligibility period for a special-event involving multiple players.

BACKGROUND

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "secondary" or "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive jackpot. In the gaming industry, a "progressive" involves the collecting of coin-in data from participating gaming device(s) (e.g., slot machines), contributing a percentage of that coin-in data to a jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain pay line. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement. In existing progressive games, once a player at a first gaming machine enters the progressive game, the players at the other gaming machines are not involved in the progressive game. In other words, the other players do not get the opportunity to participate in the progressive game.

While these player appeal features provide some enhanced excitement relative to other known games, there is a continuing need to develop new features for gaming machines to satisfy the demands of players and operators. Specifically, the current progressive games only provide enhanced excitement to the player invited to play for the jackpot. Thus, there is a need for engaging multiple players after one player enters the progressive game.

SUMMARY

According to one example, a gaming system for conducting a wagering game includes a first gaming terminal and a second gaming terminal. The gaming system includes at least two input devices, at least two display devices and at least one processor. At least one memory device stores a plurality of instructions which, when executed by the at least one processor, cause the at least one processor to operate with the at least two display devices and the at least two input devices. The processor operates to display primary wagering games to the first and second gaming terminals in response to receiving one or more wagers at the respective gaming terminals. A first perceived-value enhancement is displayed to the first gaming terminal. The first perceived-value enhancement is active for a first limited period of time and is capable of enhancing a subsequent bonus event. A bonus event is triggered and provided to at least one of the first and second gaming terminals. An enhanced bonus event is provided to the first gaming terminal in response to the bonus event triggered for the first gaming terminal while the first perceived-value enhancement is active.

According to another example, a computer-implemented method of conducting a wagering game on a gaming system is disclosed. Wagers are received via input devices associated with a plurality of gaming terminals. In response to each of the input wagers, an instance of a base game on a display device associated with at least of one of the respective gaming terminals is displayed. A first perceived bonus-award enhancement to a first gaming terminal is displayed for a first limited period of time. The first perceived bonus-award enhancement is capable of enhancing a subsequent bonus event. A second perceived bonus-award enhancement is displayed to a second gaming terminal for a second limited period of time. The second perceived bonus-award is being capable of enhancing a subsequent bonus event. A bonus event is triggered. An enhanced bonus event is provided to the first gaming terminal in response to the bonus event being triggered during the first limited period of time. An enhanced bonus event is provided to the second gaming terminal in response to the bonus event being triggered during the second limited period of time.

According to yet another example, a method of conducting a wagering game on a gaming system is disclosed. Wagers are received via input devices associated with a plurality of gaming terminals. In response to each of the input wagers, an instance of a base game on a display device associated with the respective gaming terminals is displayed. A perceived bonus-award enhancement to a first gaming terminal for a limited period of time is provided. A community event is triggered. Eligible gaming terminals are selected from the plurality of gaming terminals to participate in a community bonus event when the community event is triggered. The selected gaming terminals include the first gaming terminal and a second gaming terminal. The community bonus event is displayed to at least the first and second gaming terminals. In response to the community event being triggered during the limited period of time, the first gaming terminal is provided with an enhanced community event with respect to the second gaming terminal.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4B is an illustration of another gaming system of interconnected gaming terminals and signage including a community feature;

FIG. 5A-5C are diagrams of the gaming system in FIG. 4 showing the sequence of awarding an award from a community feature;

Figure 1:
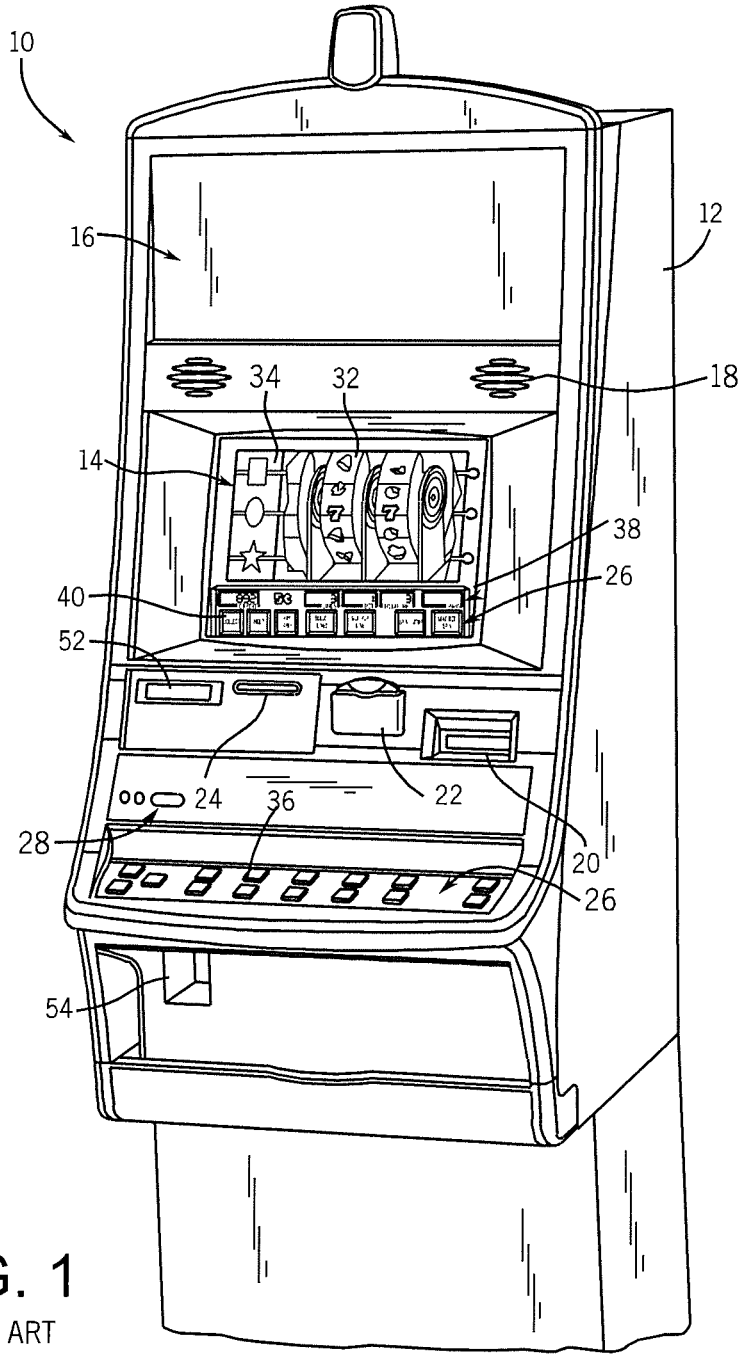
FIG. 1 PRIOR ART
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
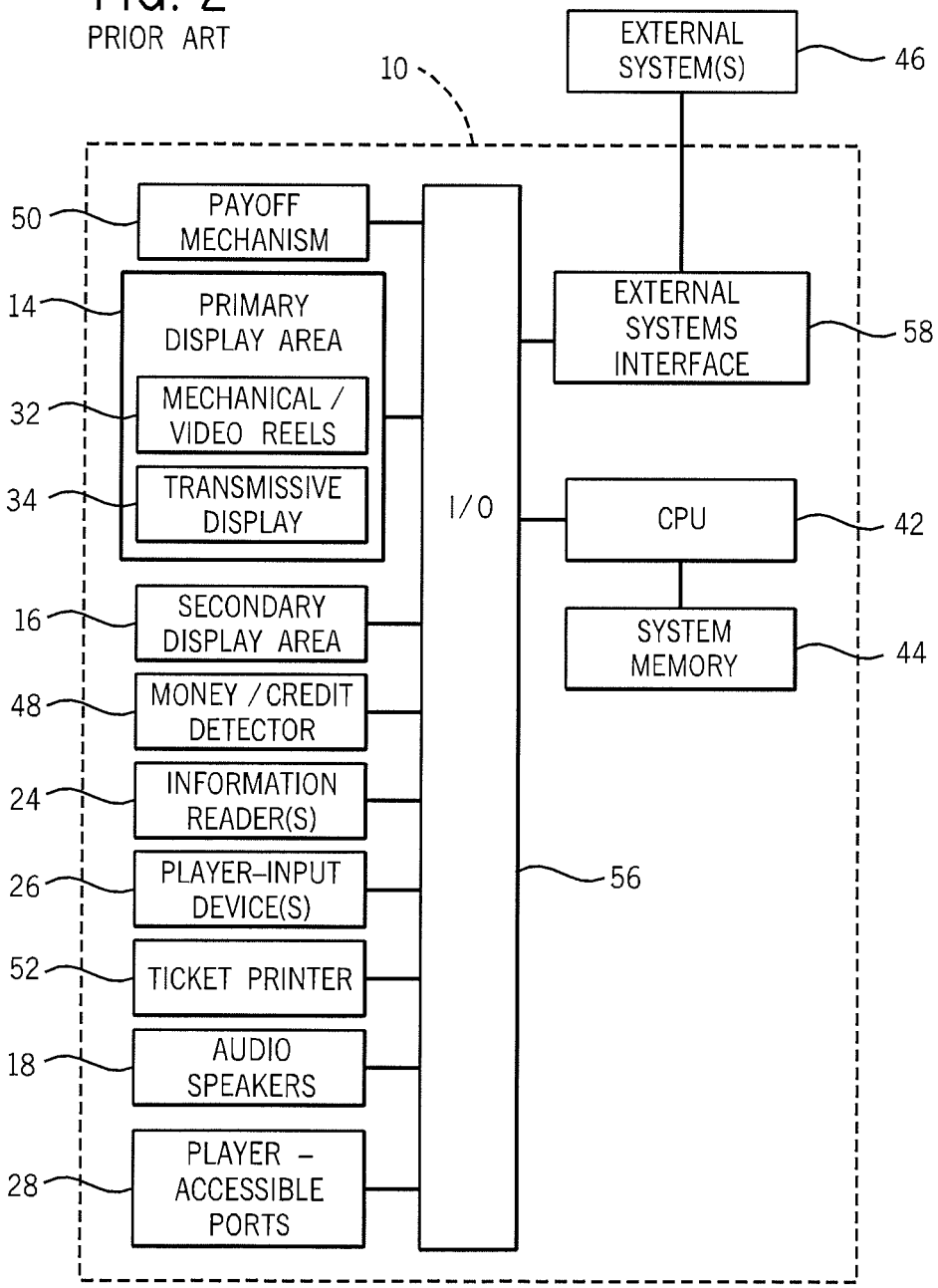
FIG. 2 PRIOR ART
FIG. 2 is a schematic view of a gaming system according to an embodiment of the present invention.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming terminal 10 or to an external system 46 associated with the gaming terminal can receive the data on the telephone line or conveyed through the communication path (e.g., via external systems interface 58) and output the data to a bus, which transmits the data to the system memory 44 associated with the processor of the controller 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
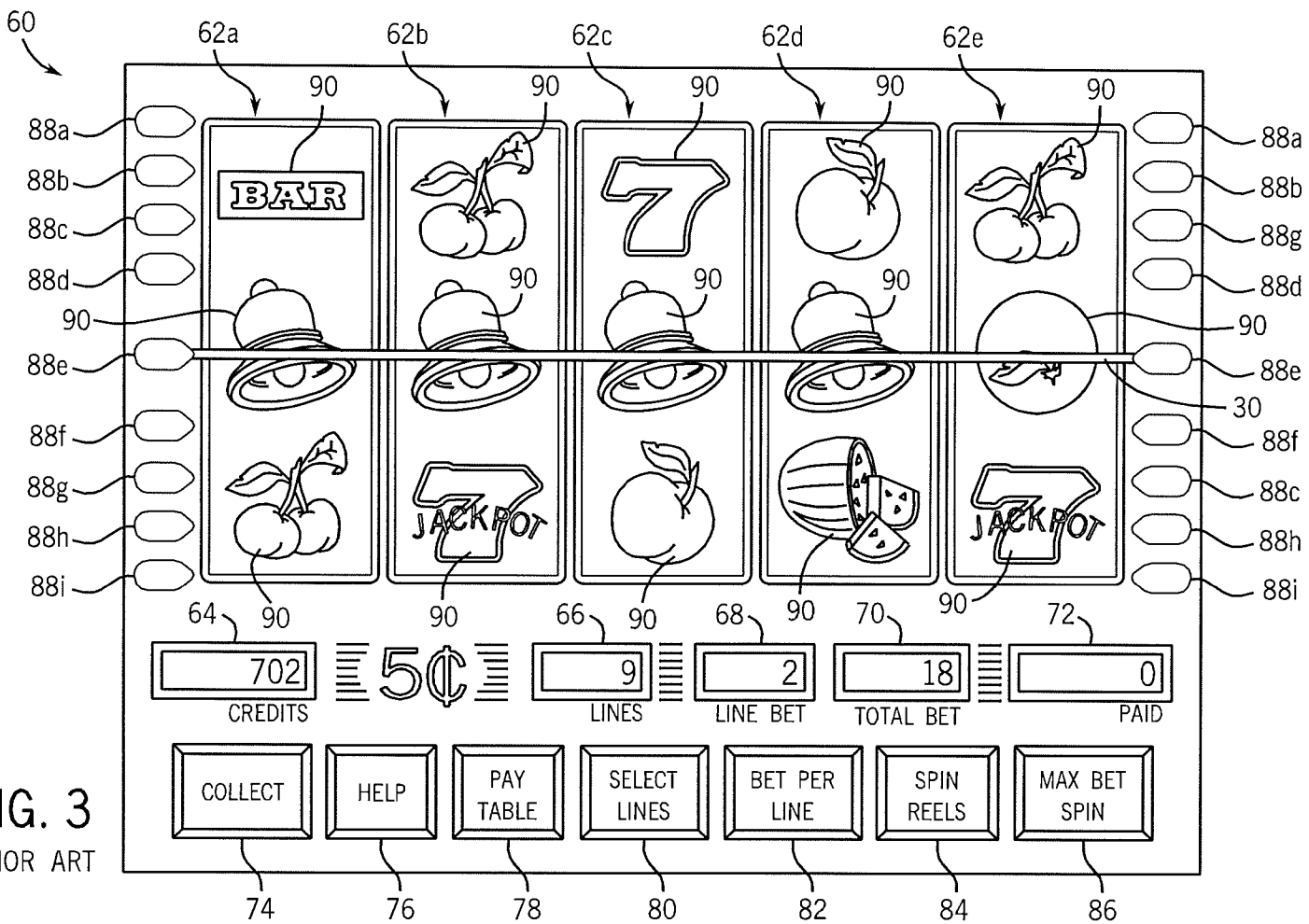
FIG. 3 PRIOR ART
FIG. 3 is an image of an exemplary basic-game screen of a wagering game displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. One example of a game format and theme is the WIZARD OF OZ™ movie. Another example of a theme is the MONOPOLY™ board game. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager, which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an example with nine paylines is shown, a wagering game with no paylines, a single payline, or any plurality of paylines will also work with the enhancements described below. Additionally, though an embodiment with five reels is shown in FIG. 3, different embodiments of the gaming terminal 10 comprise a greater or lesser number of reels in accordance with the present invention.

Figure 4A:
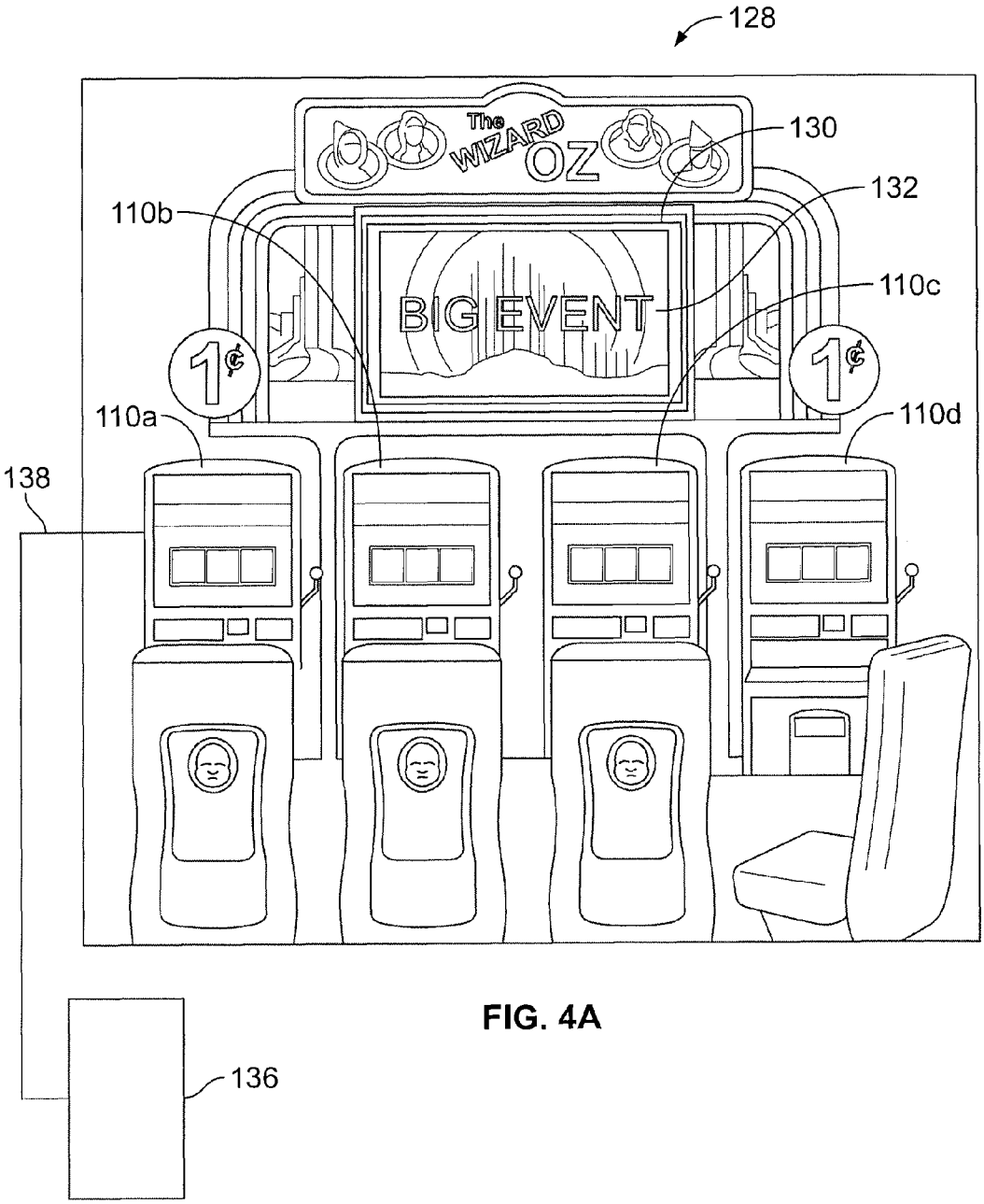
FIG. 4A is an illustration of a gaming system of interconnected gaming terminals and signage including a community feature.

Referring now to FIG. 4A, a gaming system 128 comprising a bank of gaming terminals 110*a-d* is illustrated in connection with awarding an enhancement that has a perceived increase in value in a community event. In this example, the gaming system 128 has a WIZARD OF OZ theme. The gaming terminals 110*a-d* may be of the type described above with respect to FIGS. 1-2 or any other type of gaming terminal suitable for operating a wagering game. The gaming system 128 has at least two input devices such as wager input devices and at least two display devices on the respective gaming terminals 110*a-d*. The gaming terminals 110*a-d* are interconnected and included under signage 130. The signage 130 includes a community display 132 for displaying a community event such as a community bonus game thereon. According to one embodiment, the community display 132 is one or more plasma displays visible to each player seated at the bank of gaming terminals 110*a-d*.

As shown in FIG. 4A, the signage 130 includes at least one processor such as a signage controller 136 connected to one or more of the gaming terminals 110*a-d* via a set of communication links 138 and transmits information to and receives information from the CPU (FIG. 2) in one or more of the gaming terminals 110*a-d* throughout the wagering game. Alternatively, there may be wireless communication links between the gaming terminals 110*a-f* and the signage controller 136. The gaming system 128 allows for various aspects of the gaming terminals 110*a-d*, such as playing communal games allowing for participation by two or more players of the gaming terminals 110*a-f*, to be controlled through the signage controller 136. While the signage controller 136 may be utilized to control the communal games, another controller in the gaming system 128 may alternatively, or additionally, be used to control the communal games or portions thereof. The controller may be completely independent from the signage 130 and located in any one of the gaming terminals 110*a-d*, or external to both the gaming terminals 110*a-d* and the signage 130.

FIG. 4B shows another gaming system 150 comprising a bank of gaming terminals 160*a-f* is illustrated in connection with awarding an enhancement that has a perceived increase in value in a community event. In this example, the gaming system 150 has a MONOPOLY theme. The gaming terminals 160*a-f* may be of the type described above with respect to FIGS. 1-2 or any other type of gaming terminal suitable for operating a wagering game. The gaming terminals 160*a-f* are interconnected and included under signage 170. The signage 170 includes a community display 172 for displaying a community event such as a community bonus game thereon. According to one embodiment, the community display 172 is one or more plasma displays visible to each player seated at the bank of gaming terminals 160*a-f*. The signage 170 includes a signage controller 176 connected to one or more of the gaming terminals 160*a-d* via a set of communication links 178 and transmits information to and receives information from the CPU (FIG. 2) in one or more of the gaming terminals 160*a-d* throughout the wagering game.

The community event may be initiated by achieving a winning combination of symbols or another combination of symbols, or a special symbol on any of the gaming terminals 110*a-d* within the bank or may be a "mystery" triggered independent of the symbols appearing on the gaming terminals 110*a-d* in FIG. 4A. For example, a community bonus game may be triggered by a specific outcome from the randomly selected outcomes occurring for a base game played by each of the players on one of the gaming terminals 110*a-d*. In some examples, a max bet will be required for a player to be eligible for triggering the community bonus event. In other examples, any wager may be sufficient for a player to be eligible and thus a max bet is not required to be eligible to trigger the community bonus event.

According to one example, a community bonus event includes a plurality of graphic elements displayed on the community display 132. One or more of the plurality of elements has a communal value associated therewith. The communal value represents the base award provided to each player participating in the community bonus event when a particular element is earned. As will be discussed below with respect to FIGS. 5-6, the communal value may be increased for each player participating in the community event based on the value-enhancement parameter that has been earned by the individual player. The community event may be, for example, a MONOPOLY ONCE AROUND™ bonus game as in FIG. 4B, a GREAT AND POWERFUL OZ™ bonus game as in FIG. 4A, or any other type of communal game or theme. The community event may therefore be interactive such as a picking game where all eligible players make selections, or may be a non-interactive event that displays outcomes and events without player selection or input. Another variation of a community bonus game relates to a MONOPOLY GRAND HOTEL™ game where four featured MONOPOLY™ characters emerge from an elevator and are joined by guests that jump onto MONOPOLY™ board spaces one at a time for associated credit values, or a mini bonus that awards a credit value. After the guests complete their jumps, the characters receive a multiplier and jump onto a board space. Players are awarded the credits of all the guests and their chosen character only. Any credits won during the community bonus game may be multiplied by the player's individual multiplier as will be explained below.

Each player may be awarded various individual and/or community-bonus event multipliers, which may be effective for a certain period of time if the community event is triggered. For example, one to three scattered THE WIZARD OF OZ™ symbols on one of the gaming terminals 110*a-d* may temporarily boost the individual's multiplier. The multiplier may be applied to any community awards earned by the players participating in a community bonus game. In another example, the third reel of each of the wagering games on the gaming terminals 110*a-d* may include a symbol called the Multiplier Boost. This symbol, when appearing in any final position on the third reel, awards additional time on the player's individual eligibility meter, which may result in a temporary increase of the individual multiplier. The additional time awarded may be proportional to the size of the player's bet, so larger bets result in larger increases in the multiplier. As will be explained below, the gaming system 128 includes at least one memory device which stores a plurality of instructions which are executed by a processor such as the controller 42 in FIG. 1 or the controller 136. The gaming system 128 causes at least one processor to operate with at least two display devices and at least two input devices on the gaming terminals 110*a-d* in this example to display primary wagering games to gaming terminals 110*a-d* in response to receiving one or more wagers at the respective gaming terminals. A first perceived-value enhancement is displayed to at least a first gaming terminal such as the gaming terminal 110*a*. The first perceived-value enhancement is active for a first limited period of time. The first perceived-value enhancement is capable of enhancing a subsequent bonus event. A bonus event is triggered and provided to at least one of the gaming terminals 110*a-d*. An enhanced bonus event is provided to the first gaming terminal such as the gaming terminal 110*a* in response to the bonus event triggered for the first gaming terminal while the first perceived-value enhancement is active.

In this example, the gaming terminals 110*a-d* determine whether the particular player is eligible for the community bonus game. Eligible players may also be eligible for future bonuses or multipliers as explained above. Once a community bonus event has been initiated, a plurality of players at the bank of gaming terminals 110*a-d* are selected to participate in a communal wagering game based on their eligibility for the community event. According to one example, the players are selected based on their time eligibility as determined by their recent wager history.

FIG. 5A shows the images displayed on the displays of the gaming terminals 110*a*-110*d* and the community display 132 on the signage 130 in FIG. 4A. As shown in FIG. 5A, each of the displays on the individual gaming terminals 110*a-d* display a community game bonus window 500*a-d* including a timer field 502*a-d* and a multiplier field 504*a-d* respectively. The timer fields (e.g., timer field 502*a*) displays the amount of time a player may be eligible to receive the bonus from the community game images 510 displayed on the community display 132. As explained above, the amount of the multiplier in the multiplier fields 504*a-d* on the gaming terminals 110*a-d* may be awarded to players based on different outcomes in the base game on the specific gaming terminal 110*a-d*. In this example, the value of the multiplier increases with each additional bonus-multiplier triggering outcome achieved in the base game during the time period. As explained above, this may be a special symbol in one of the reels or the occurrence of a group of scatter symbols. Therefore in this example, the gaming terminal 110*a* has an eligibility time of 60 seconds with a multiplier of 10× as shown in the bonus window 500*a*, the gaming terminal 110*b* has an eligibility time of 15 seconds with a multiplier of 5× as shown in the bonus window 500*b*, the gaming terminal 110*c* has an eligibility time of 45 seconds with a multiplier of 2× as shown in the bonus window 500*c*, and the gaming terminal 110*d* has an eligibility time of 10 seconds with a multiplier of 50× as shown in the bonus window 500*d*.

The community bonus game in this example includes a wheel 512, which includes various prize indicators 514. When the community event is triggered, the wheel 512 is spun and an indicator such as a pointer 516 shows the selection of one of the prize indicators 514. The bonus game awards all the eligible players on the gaming terminals 110*a*-110*d* the resulting outcome indicated by one of the prize indicators 514. In this example, the prize indicators 514 include bonus credits, multipliers, and special selections as will be explained below.

Figure 5B:
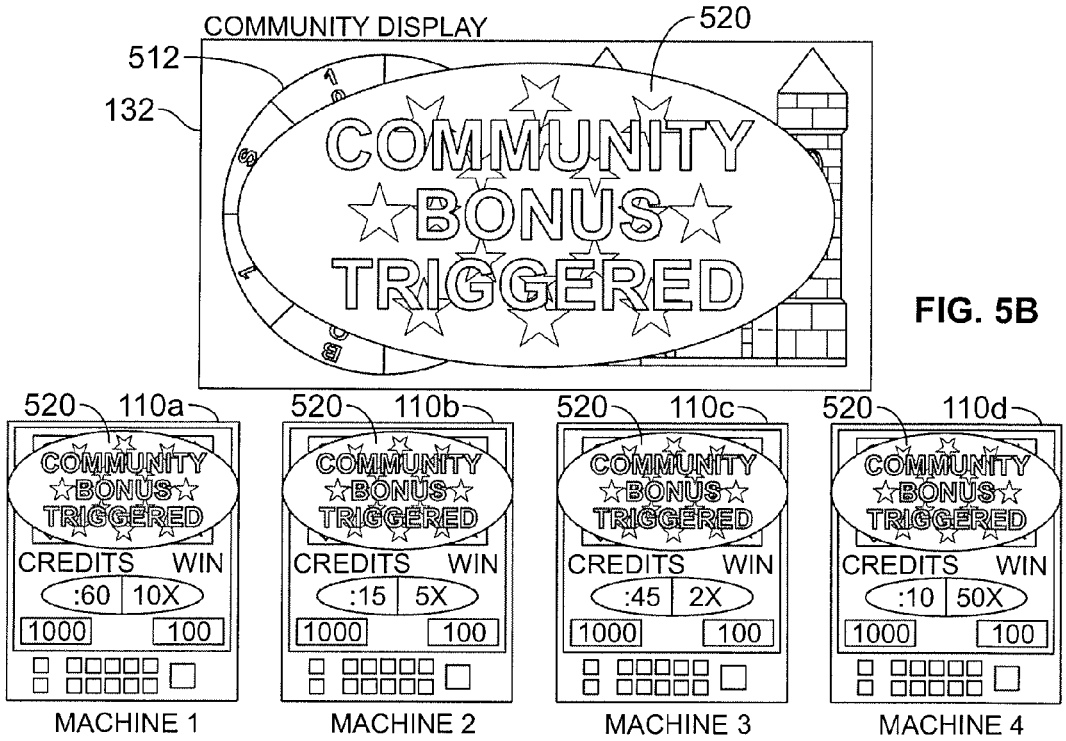

FIG. 5B shows an informational graphic 520 displayed on the community display 132 when the community bonus is triggered. As shown in FIG. 5B, the informational graphic 520 is displayed on the community display 132 and the same informational graphic 520 may be displayed on all of the gaming terminals 110*a-d* that are eligible for the community bonus. During the play of the base games on the gaming terminals 110*a-d*, the community display 132 may show graphics representing whether a community event is triggered. For example, the reels of one or all of the gaming terminals 110*a-d* may be displayed, showing the potential for triggering a community event. Alternatively, other graphics such as playing cards being flipped over to reveal a triggering condition for the community event may be shown.

Figure 5C:
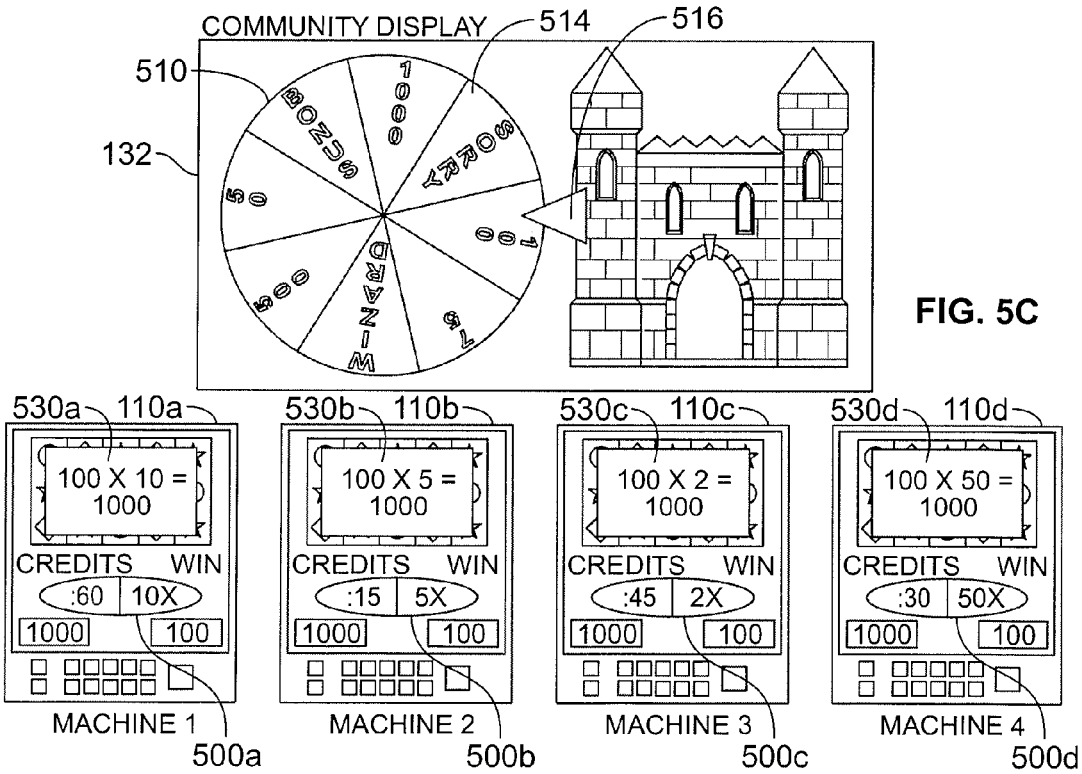

The players therefore participate in a community bonus event such as being awarded the outcomes of a spin or spins of the wheel 512. FIG. 5C shows the graphics displayed on the community display 132 based on a spin of the wheel 512. In this example, the wheel 512 is spun and the pointer 516 indicates that a prize indicator 514 of the wheel has been selected and awards 100 credits. Each of the eligible gaming terminals 110*a-d* applies an individual bonus multiplier according to the respective bonus window 500*a-d* as shown in FIG. 5C based on the results of the spin. Since the multipliers are different for each gaming terminal 110*a-d*, different credit amounts are awarded to each of the eligible players. The credit awards based on the multipliers for each gaming terminal 110*a-d* are displayed on respective bonus-award windows 530*a-d*. Thus the amounts awarded to each of the eligible gaming terminals 110*a-d* are different because of the different multipliers earned by each player playing the gaming terminal.

Time eligibility is measured using, for example, a time slice, which is the amount of time that a wagered amount gives eligibility to the player for entry into the communal wagering game. A time-slice counter such as the timer field 502*a-d* in FIGS. 5A-5C is used to increment and/or decrement time slices for increasing and/or decreasing the time that the player is eligible to participate in the community event. If the player has eligibility during an increment of time when the community event is triggered, then the player is allowed to participate in the community event such as a community bonus game. The time slice increments may therefore be another input to control expected value for the mathematics of the base game and the community event game. In addition, or as an alternative, to time slices based on wager amounts and/or turnover, community eligibility or enhancements may be accrued via wagering-game outcomes or results that a player has achieved over one or more plays of a wagering game.

The players are thus provided with a value-enhancement parameter such as the example multipliers as shown by the multiplier fields 504*a-d*. The value enhancement parameters are applied within the community wagering game based on the player's betting history or other factors. The value-enhancement parameter may include a plurality of levels that can be earned by the player by wagering on the basic wagering game. In this example, each level has a certain maximum number of purchasable time slices that are added to the time-slice counter such as the timer fields 502*a-d* on the gaming terminals 110*a-d* to extend the eligibility to participate in the communal event.

In order to increase the excitement of players, there are a number of alternatives available to increase the perceived-value in a community event such as a community bonus game while maintaining the same expected value payoff for the community based bonus game as will be discussed below with respect to FIGS. 6A-6C. Thus, the overall value or mathematical model of the base game and the community-bonus event is the same regardless of the provision of the perceived enhancements, but players perceive being awarded something of value. For example, perceived-value enhancements may be awarded as a supplement to a community event if the community event is triggered while the enhancement was active. The term "perceived" is being used to signify that the enhancement is not necessarily awarded to the player, but merely available to them if an independent event occurs while the enhancement is offered. For example, a perceived-value enhancement may be to give each player a 2× multiplier for any award achieved in a community event. To actually be awarded that value, two subsequent events must occur while that perceived-value enhancement is active, first, a community event must be triggered, and second, the community event must determine at least one award (which is then multiplied) to be awarded to the player.

Because a perceived-value enhancement requires a subsequent triggering event to be awarded, by setting the average length of time that a perceived-value enhancement is active to be less (or much less) than the average length of the subsequent triggering event, numerous perceived-value enhancements can be displayed over the course of wagering-game play, however, many (or most) of these perceived-value enhancements can expire, on average, before a subsequent trigger occurs. For example, if a perceived-value enhancement has an average duration of fifteen seconds, but the average time between community-event triggers is five minutes, numerous perceived-value enhancements may be offered to the player over the five minutes, but only a few, if any, would still be unexpired when the community-event trigger occurs-meaning they will actually be utilized to enhance the community event.

Figure 6A:
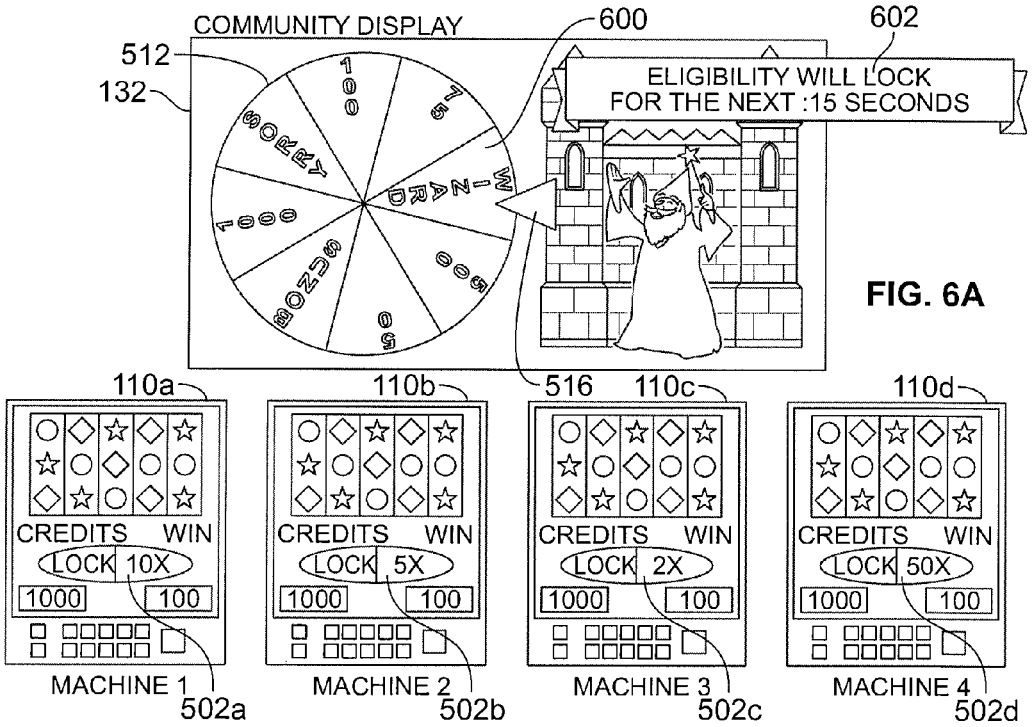
FIG. 6A-6D are diagrams of the gaming system in FIG. 4 that award perceived increased value enhancements to players during the time slices for eligibility for the community bonuses.

FIG. 6A shows one example of an outcome of the wheel 512 where a "wizard" selection 600 results in a time clock boost perceived-value award as an outcome of the community bonus event. The wizard selection 600 is part of the wheel 512, which may be selected as an outcome of the community bonus event. The outcome from the wizard selection 600 awards one or more perceived-value enhancements. In this example, the players are awarded by holding all eligibility time-slice clocks without decrementing the clocks on the gaming terminals 110*a-d* for a specific time duration. The time duration for the freeze may be displayed on the community display 132 in an informational graphic 602. Thus, as shown in FIG. 6A, the lock is awarded for 15 seconds. The timer fields 502*a-d* in the gaming terminals 110*a-d* display a LOCK symbol signifying that the clocks do not count down for a specified period of time such as the 15 seconds shown in the informational graphic 602. In this manner, the players receive a perceived increase in award value of "free" additional eligibility time as an award from the community bonus event. An alternative is a clock boost where the time periods for the eligibility in the time fields 502*a-d* actually increase by adding time for each wager made by a player instead of displaying the LOCK symbol. In some examples, after the lock has expired, the eligibility time-slice clocks may immediately or rapidly decrease down to the level that they would be at but for the lock. In other embodiments, the time clock may not be held, but instead the individual multiplier level may be held for a predetermined length of time, after which it decrements to its natural level.

The community bonus game may include several options such as the sections in the wheel 512 and the perceived increase in value may award players another bonus option on the wheel 512 that may be available for a limited period of time. The additional bonus option may either be added to available selections or replace selections representing lower bonuses or multipliers on the wheel 512 for a certain limited period of time. The award of the bonus is still dependent on the triggering condition for the community bonus event, but the value of the bonus option is higher than a normal award option.

Figure 6B:
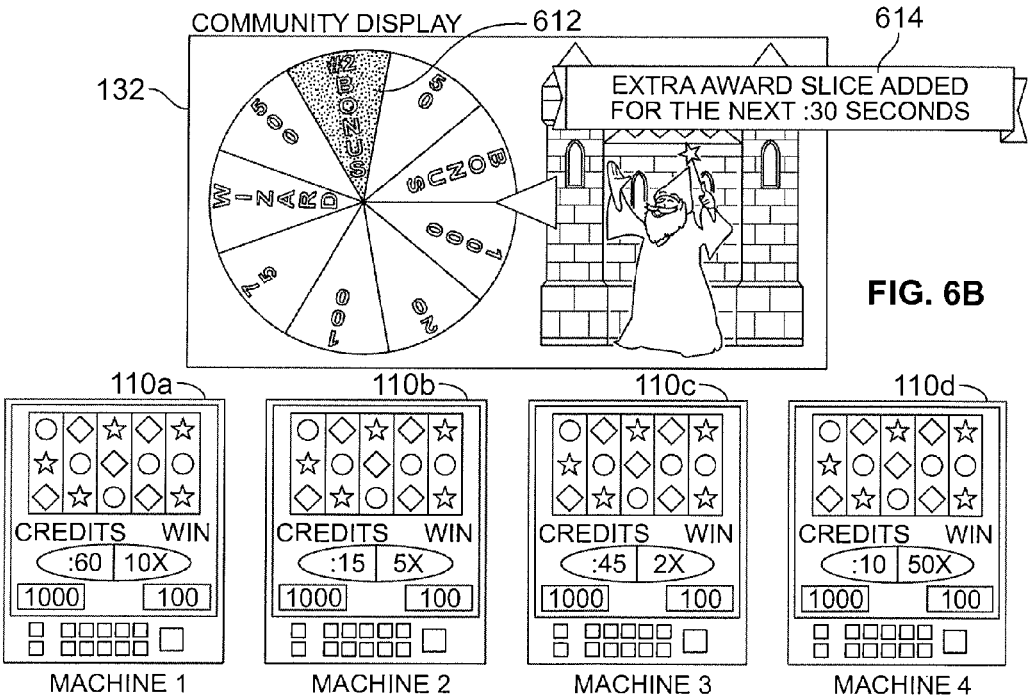

FIG. 6B shows an example of adding a bonus selection to offer a perceived-value option triggered by the selection of the wizard selection 600. A new bonus-award section 612 is added to the wheel 512 for a pre-determined time duration. An informational graphic 614 shown on the community display 132 indicates that the extra award slice is added for a specified period of time, which is 30 seconds in this example. Thus, additional spins for the wheel 512 will provide the opportunity to be awarded the special new bonus-award section 612. Alternatively, the opportunity to obtain the bonus-award section 612 may be carried over to the next occurrence of the community event. After the specified time expires, the new award section 612 will be removed from the wheel 512. Alternatively, the new award section 612 may be removed if the bonus is awarded or if the new bonus-award is not awarded before the specified period of time runs out.

Figure 6C:
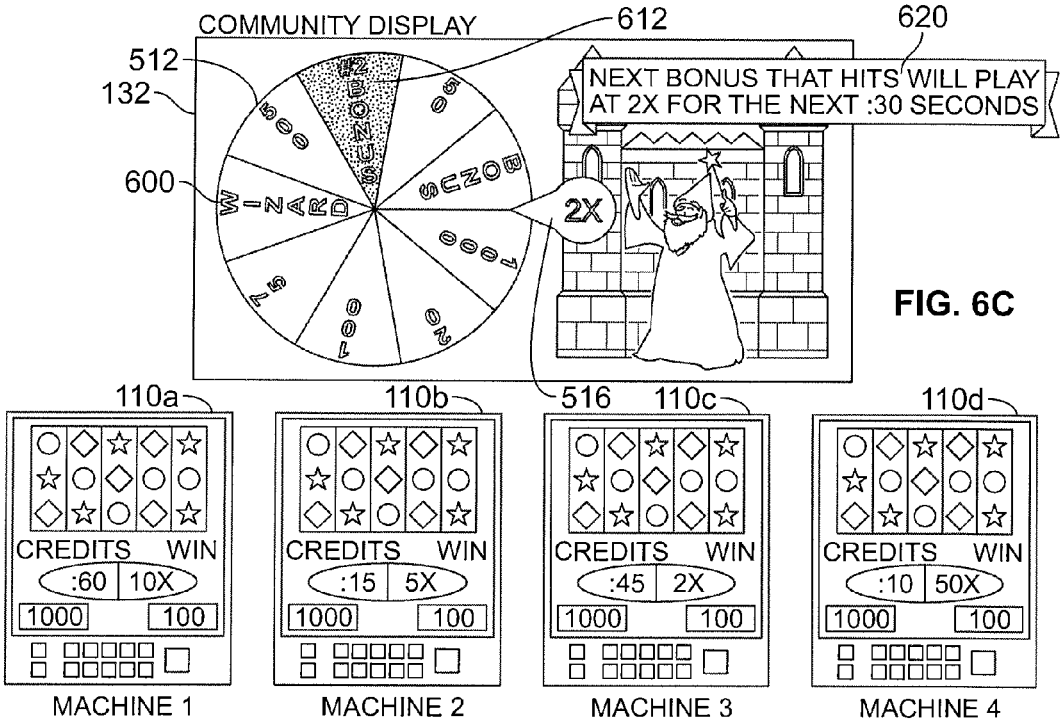

FIG. 6C shows another example of a perceived-value enhancement triggered by the wizard selection 600 in the community bonus event. In this example, a multiplier boost is applied to the next bonus section that is awarded to the players participating in the community bonus event. As shown in FIG. 6C, an information graphic 620 is shown on the community display 132 that indicates that the next time a bonus section of the wheel 512 is triggered, the awards will be doubled. In this example, the multiplier is 2× as indicated by the pointer 516 and the informational graphic 620 and the time is 30 seconds. This increase in perceived-value may carry over to the next triggering of a community event. Further, the multiplier boosts may reinforce each other for certain periods of time that span the period of playing the community bonus game as well as additional community bonus games. For example, if a player earns a multiplier boost for 30 seconds and earns another multiplier boost during that time, the overall boosts may be combined for the time that the periods of times of the boosts overlap.

The increase in perceived values may also be combined with other perceived-value features. For example, in FIG. 6C the extra bonus of the new award section 612 from FIG. 6B is still present on the wheel 512 providing the players the additional excitement of hitting an extra perceived bonus, which is then multiplied according to the enhanced value option in FIG. 6C.

Although a wheel based bonus game is shown in FIG. 6C, the concept of applying a multiplier boost to certain community bonus game outcomes may be applied to other types of community games. For example, the multiplier boost may be applied to a WIZARD OF OZ™ themed community game based on selection of WIZARD OF OZ™ characters and associated bonuses. In such a community bonus game, each player is assigned or selects WIZARD OF OZ™ characters that may be assigned bonuses during the community game. When a bonus associated with a particular character is selected, the player(s) associated with that character is awarded a bonus event. Thus, in a game with four main characters, perceived-value enhancements can be awarded to each character over time, although only a single character may actually be selected for the bonus event. It should be apparent from the above that, on average, at least 4.times. more perceived-value awards can be offered over time than the number of bonus events that will be triggered (and therefore, convert the perceived-value award into a potentially utilized enhancement). For example, if the perceived-value multiplier boost is triggered, and a character bonus is activated, such as the next triggering of a SCARECROW bonus within the time period, this allows the associated bonus-award to be multiplied by the boost denomination. Another example is the increase in triggering conditions based on more characters triggering the bonus in the example WIZARD OF OZ™ community game. In this example, rather than one character, such as the SCARECROW, triggering the multiplier boost, all four characters, SCARECROW, TIN MAN, LION, and DOROTHY trigger the multiplier boost.

Alternatively, each character may have a specific feature that may be triggered in the community bonus game that may be awarded in addition to any other bonus such as the multiplier boost awarded for a certain time slice. Other perceived-value enhancements for application to bonus-awards awarded may nullify or remove an adverse outcome, such as a game termination outcome, for the player selections of a community selection type game. Thus a player may be awarded such a nullification award, which may be applied to cancel a later occurring game termination outcome, allowing the bonus game to continue.

Another perceived-value enhancement is a "Big Money" spin that allows the increase of individual player multipliers via different triggering conditions such as different wins in the basic game boosting the individual player multipliers for a certain time slice. Alternatively, the "Big Money" spin may randomly select one of the different triggering conditions in the base game for boosting the individual multiplier.

Figure 6D:
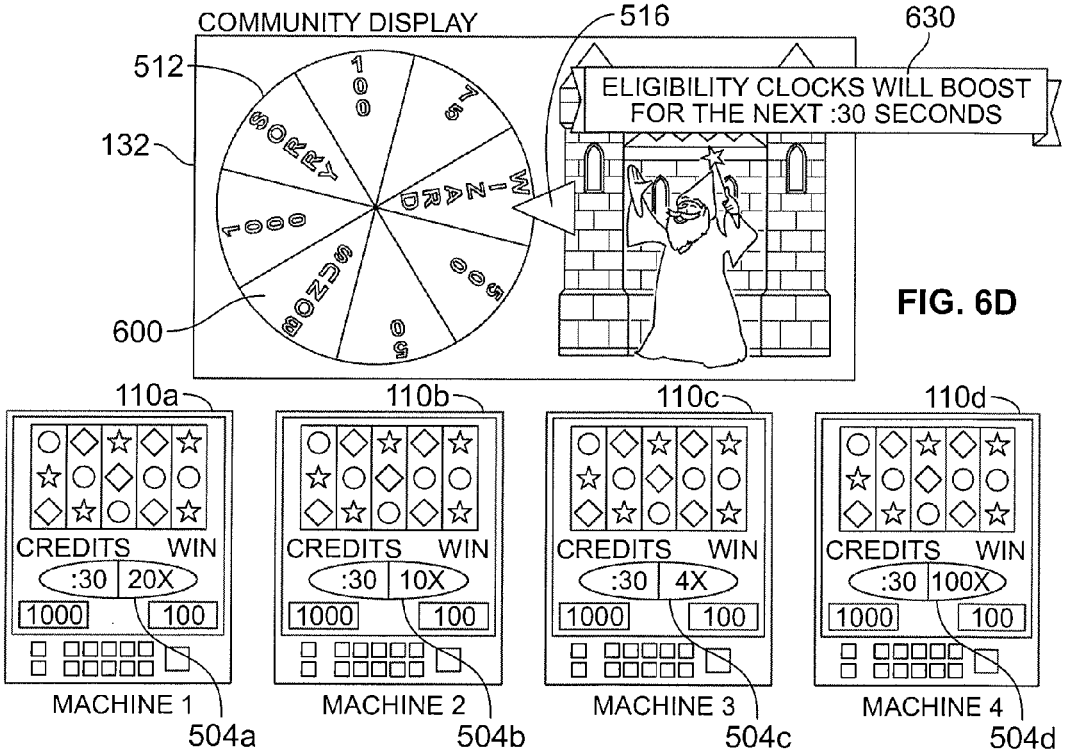

FIG. 6D shows an example of the "Big Money" perceived-value enhancement triggered by the Wizard selection 600 on the wheel 512. In this example, the "Big Money" enhancement causes an increase in all eligibility multipliers for a specific time period, which increases the individual multiplier(s) for all eligible players. An informational graphic 630 is displayed on the community display 132 that informs the players that the multiplier for each eligible gaming terminal is boosted for 30 seconds. The multiplier fields 504*a-d* on each of the gaming terminals 110*a-d* are therefore doubled as seen in FIG. 6D. If an award is awarded by the community bonus game in the time period, the award is doubled for all eligible players. After the given time period is over, all the multipliers on the gaming terminals 110*a-d* return to the original unboosted multiplier values.

In order to prevent vulturing (players hovering around gaming terminals to capitalize on potential enhancements on the gaming terminals), the frequency of the bonuses and perceived-value enhancements may be changed such that each community bonus occurrence may vary with the eligibility times when the bonus may be awarded to the players.

The size of the multiplier bonus may also be coupled with the number of time slices that are awarded to a player. Alternatively, a multiplier bonus may be converted into more time slices. A player may also be offered enhanced time slices where a player may increase a wager and therefore increase the potential multiplier for the time.

Non-eligible players may still trigger the community event such as a community bonus game for other players. Also, players previously playing may benefit from the community bonus game being triggered and share in the award even if not present. Players may also receive additional benefits from eligibility in the community bonus. For example, players may be awarded secondary points, such as for SECOND LIFE™ on player accounts associated with a player tracking card. Players may also be afforded the opportunity to place additional wagers on outcomes of the community bonus game rather than being awarded automatic participation if they are eligible. Player may also be afforded the opportunity to place side wagers on the outcomes of the community bonus game for enhanced awards.

The community bonusing may also be collaborative with all of the players playing together or against each other. An example of such a collaborative bonus game is a picking game allowing all players to make selections from a community array of selections. With regard to a community picking game, extra picks may be awarded during certain time slices. For example, if a bonus is earned, the player may be provided the opportunity to win extra picks during the time slice in addition to the picks earned during that period. Alternatively, one player who has the highest multiplier when the community bonus game is triggered may be allowed to make all the picks thereby creating more incentive to play the base games faster to earn bigger multipliers.

The average credit amount awarded by the community bonus event after it is triggered may also be adjustable. For example, the credit amount may begin at 1,500 credits and decrease in value until the community bonus event is triggered. This provides incentives for the players to play the gaming terminals 110*a-f* faster. Since the increased credit amount may be determined based on the mean during the eligibility period, the expected value remains the same as if the credit amount for the award was at the mean.

Another type of bonus that may be awarded from a community bonus event may be an outcome that triggers another community bonus event. Alternatively, there may be different types of community games and a sequence of activation may trigger each successive game. Thus, the base games on the gaming terminals 110*a-d* may trigger a first community bonus event. An outcome in a first community bonus game may trigger a different second community bonus event. The probability of triggering a second community bonus event may be increased if a perceived bonus is awarded in the first community bonus event. For example, in a reel type community bonus game, two reels could be locked with symbols to trigger the second community bonus game thereby only requiring the selection of one triggering symbol in the third reel.

Figure 7:
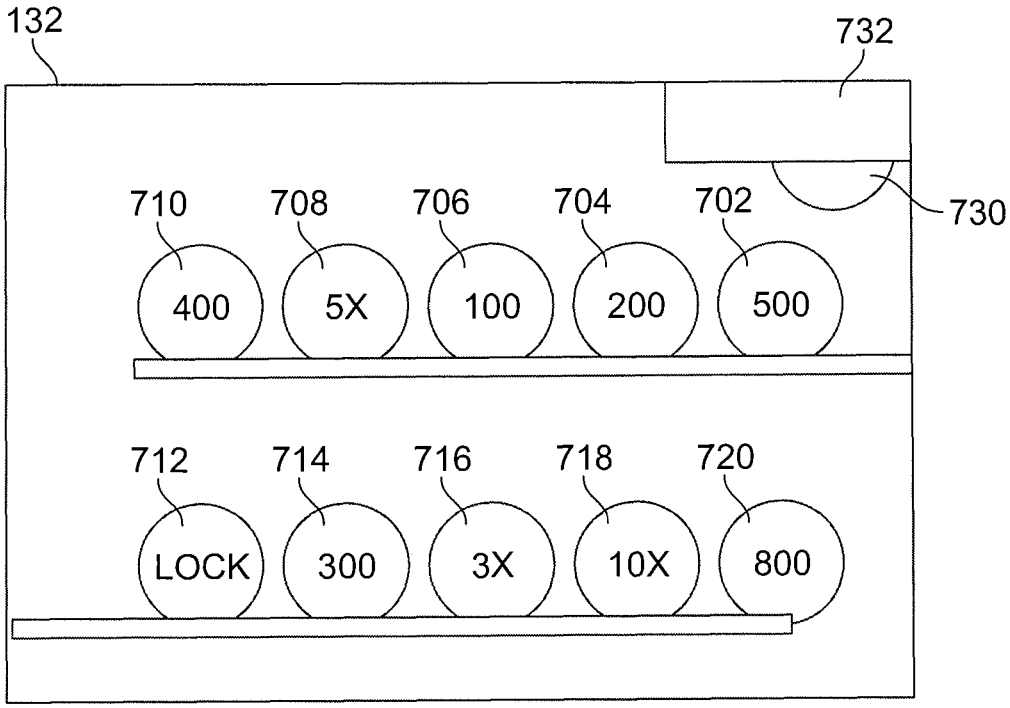
FIG. 7 is an image of a gaming system community display indicating the bonuses available for a community based feature.

The community display 132 in FIG. 4 may also be used to show different graphics representing outcomes of a community bonus such as a community bonus game. Such graphics may include information about the true odds of obtaining certain outcomes. FIG. 7 shows an image that may be displayed on the community display 132 in FIG. 5 showing a graphic used for showing community bonus-awards. FIG. 7 shows a plurality of balls 702, 704, 706, 708, 710, 712, 714, 716, 718, and 720 that each show a credit award such as balls 702 and 720, or multipliers on balls 716 and 718. The community bonus game in this example allows a random selection of one of the balls 702, 704, 706, 708, 710, 712, 714, 716, 718, and 720 to be awarded to eligible players.

Each time a ball such as the ball 720 is dropped, it is replaced by another ball 730 from a chute 732. The balls 702, 704, 706, 708, 710, 712, 714, 716, 718, and 720 are rotated by dropping a ball during each eligibility time slice such as every 15 seconds, thereby changing the awards available if the community game is triggered during that time slice. In this manner, the potential awards change for the community game and the players may see the likelihood of selecting one of the outcomes. Alternatively, a random ball from the balls 702, 704, 706, 708, 710, 712, 714, 716, 718, and 720 may be selected for replacement rather than the sequence of balls 702, 704, 706, 708, 710, 712, 714, 716, 718, and 720 shown in FIG. 7. Therefore, the player may see a large number of potential awards and/or enhancements as the balls cycle through the chute(s), but only one or a few of the balls are actually selected to potentially provide an award or enhancement to a player.

Each of these embodiments and obvious variations thereof is contemplated as falling within the spirit and scope of the claimed invention, which is set forth in the following claims.

What is claimed is:

1. A gaming system including a first gaming terminal and a second gaming terminal, the gaming system comprising:

at least two input devices;

at least two display devices;

at least one processor; and at least one memory device which stores a plurality of instructions which, when executed by the at least one processor, cause the at least one processor to operate with the at least two display devices and the at least two input devices to:

display primary wagering games to the first and second gaming terminals in response to receiving one or more wagers at the respective gaming terminals, display a first perceived-value enhancement to the first gaming terminal, the first perceived-value enhancement being active for a first limited period of time, the first perceived-value enhancement capable of enhancing a subsequent bonus event, trigger a bonus event provided to at least one of the first and second gaming terminals, wherein the triggering of the bonus event has an average frequency of being triggered, the average frequency being greater during the first limited period of time, and provide an enhanced bonus event to the first gaming terminal in response to the bonus event triggered for the first gaming terminal while the first perceived-value enhancement is active.

2. The gaming system of claim 1, wherein a second perceived-value enhancement is provided to the second gaming terminal, the second perceived-value enhancement being active for a second limited period of time and capable of enhancing a subsequent bonus event.

3. The gaming system of claim 2, wherein the first perceived-value enhancement is different from the second perceived-value enhancement.

4. The gaming system of claim 2, wherein the first limited period of time is different from the second limited period of time.

5. The gaming system of claim 1, wherein the bonus event is triggered for both the first gaming terminal and the second gaming terminal while the first perceived-value enhancement is active, the first gaming terminal playing the bonus event with the perceived-value enhancement applied to the bonus event and the second gaming terminal playing the bonus event without the perceived-value enhancement applied.

6. The gaming system of claim 1, wherein the average frequency is at least ten times larger during the first limited period of time.

7. The gaming system of claim 1, wherein the first perceived-value enhancement is not provided to the first gaming terminal if the bonus event is not triggered during the limited period of time.

8. The gaming system of claim 1, wherein the perceived bonus-award enhancement includes at least one of a multiplier, a credit award, an additional award outcome, and a nullification of an adverse outcome.

9. The gaming system of claim 1, further comprising a community display coupled to the first and second gaming terminals, the community display displaying an informational graphic related to the first perceived bonus-award enhancement.

10. The gaming system of claim 1, wherein the first perceived-value enhancement is associated with a particular character, the first gaming terminal also being associated with the particular character.

11. The gaming system of claim 1, wherein the perceived bonus-award enhancement is an increase in the opportunity to trigger a second bonus event based on outcomes in the triggered bonus event.

12. A computer-implemented method of conducting a wagering game on a gaming system, the method comprising:

receiving wagers via input devices associated with a plurality of gaming terminals; displaying, in response to each of the input wagers, an instance of a base game on a display device associated with at least of one of the respective gaming terminals;

displaying a first perceived bonus-award enhancement to a first gaming terminal for a first limited period of time, the first perceived bonus-award enhancement being capable of enhancing a subsequent bonus event;

displaying a second perceived bonus-award enhancement to a second gaming terminal for a second limited period of time, the second perceived bonus-award enhancement being capable of enhancing a subsequent bonus event;

triggering a bonus event, wherein the triggering of the bonus event occurs with an average frequency, the average frequency being greater than the first limited period of time and the second limited period of time;

providing an enhanced bonus event to the first gaming terminal in response to the bonus event being triggered during the first limited period of time; and providing an enhanced bonus event to the second gaming terminal in response to the bonus event being triggered during the second limited period of time.

13. The computer-implemented method of claim 12, wherein the first perceived bonus-award enhancement is different from the second perceived bonus-award enhancement.

14. The computer-implemented method of claim 12, wherein the first limited period of time is different than the second limited period of time.

15. The computer-implemented method of claim 12, wherein the perceived bonus-award enhancements are not provided to the respective gaming terminals if the bonus event is not triggered during either the first limited period of time or the second limited period of time.

16. The computer-implemented method of claim 12, wherein the perceived bonus-award enhancements include at least one of a multiplier, a credit award, an additional award outcome, and a nullification of an adverse outcome.

17. The computer-implemented method of claim 12, wherein the first perceived-value enhancement is associated with a first character, the first gaming terminal also being associated with the first character, and wherein the second perceived-value enhancement is associated with a second character, the second gaming terminal also being associated with the second character.

18. One or more physical machine-readable storage media including instructions which, when executed by one or more processors, cause the one or more processors to perform operations comprising:

receiving wagers via input devices associated with a plurality of gaming terminals; displaying, in response to each of the input wagers, an instance of a base game on a display device associated with at least of one of the respective gaming terminals;

displaying a first perceived bonus-award enhancement to a first gaming terminal for a first limited period of time, the first perceived bonus-award enhancement being capable of enhancing a subsequent bonus event;

displaying a second perceived bonus-award enhancement to a second gaming terminal for a second limited period of time, the second perceived bonus-award enhancement being capable of enhancing a subsequent bonus event;

triggering a bonus event, wherein the triggering of the bonus event occurs with an average frequency, the average frequency being greater than the first limited period of time and the second limited period of time;

providing an enhanced bonus event to the first gaming terminal in response to the bonus event being triggered during the first limited period of time; and providing an enhanced bonus event to the second gaming terminal in response to the bonus event being triggered during the second limited period of time.

* * * * *